US005833145A

United States Patent [19]

Smith

[11] Patent Number: 5,833,145

[45] Date of Patent: Nov. 10, 1998

[54] SPRAY NOZZLE FOR HOSES

[75] Inventor: Jeffrey L. Smith, Latrobe, Pa.

[73] Assignee: Gilmour, Inc., Newark, Del.

[21] Appl. No.: 694,260

[22] Filed: Aug. 8, 1996

[51] Int. Cl.[6] ..... B05B 9/01

[52] U.S. Cl. ..... 239/526; 239/583

[58] Field of Search ..... 239/526, 583

[56] References Cited

U.S. PATENT DOCUMENTS

| | | | |
|---|---|---|---|
| 2,523,084 | 9/1950 | Aqdragna | 239/526 X |
| 2,657,098 | 10/1953 | Strahman | 239/526 X |
| 2,852,310 | 9/1958 | Francis | 239/526 X |
| 2,937,813 | 5/1960 | Rinkewich | 239/526 X |
| 2,991,945 | 7/1961 | Rosenkranz | 239/526 |
| 3,799,447 | 3/1974 | Beal | 239/526 X |
| 4,025,000 | 5/1977 | Blasnik | 239/459 |
| 4,219,162 | 8/1980 | Dadson | 239/583 |
| 4,534,512 | 8/1985 | Chow et al. | 239/526 X |
| 4,609,149 | 9/1986 | Jessen | 239/310 |
| 4,619,403 | 10/1986 | Goldney et al. | 239/456 |
| 4,666,085 | 5/1987 | Liaw | 239/526 X |
| 4,909,443 | 3/1990 | Takagi | 239/526 X |
| 5,232,162 | 8/1993 | Chih | 239/526 X |
| 5,287,994 | 2/1994 | Dempsey | 222/158 |
| 5,332,158 | 7/1994 | Styne et al. | 239/310 |
| 5,332,159 | 7/1994 | Grime et al. | 239/412 |

*Primary Examiner*—Lesley D. Morris

*Attorney, Agent, or Firm*—Polster, Lieder, Woodruff & Lucchesi

[57] ABSTRACT

A spray nozzle (10) attaches to a garden hose (H) used to water lawns and gardens comprising. A nozzle body (12) has formed in it a fluid inlet (14), a fluid outlet (16), and a fluid passage (18) extending between the inlet and outlet. The inlet attaches to the hose, and the outlet forms an orifice through which water sprays onto a lawn or garden. A valve (40) includes a valve stem (42) movable a position blocking the orifice to a position in which fluid discharges through the outlet. A handle (62) is grasped by a user of the hose and is attached to the valve stem for moving the stem relative to the orifice. The extent of this movement is a function of a desired spray pattern, this pattern being maintained so long as a constant grip pressure is maintained on the handle. A position clip (72) is movably mounted on the body is movable by the user. The clip, when in place, holds the handle in a position by which the desired spray pattern is maintained even when the user's grip pressure is released.

11 Claims, 3 Drawing Sheets

SPRAY NOZZLE FOR HOSES

BACKGROUND OF THE INVENTION

This invention relates to garden watering hoses and the like, and more particularly, to an improved spray nozzle which attaches to the end of a hose for use in watering a lawn or garden.

Many people who water their lawns and gardens do so using a hose with an attached spray nozzle. Spray nozzles are well-known in the art as illustrated by U.S. Pat. Nos. 4,219,162, and 4,025,000. In using a water hose to spray a lawn or garden, it is often desirable to adjust the spray between a concentrated spray and a widely dispersed spray. Conventional spray nozzles provide such a wide range of spray patterns. Further, it is often desirable, once a preferred spray pattern is obtained to be able to maintain that pattern throughout the watering regime. For this purpose conventional spray nozzles are often equipped with a locking element (member 34 shown in the '000 patent, for example). Use of a locking element frees up the user's hand from having to maintain a constant grip pressure for a desired spray pattern so that the user does not get tired from having to maintain a constant grip pressure. However, over time, it is common for these locking elements to rust in place, break off, or otherwise become inoperative or difficult to use. In either instance, the user again has to rely on their ability to manually control the spray pattern. What is needed is an improved spray nozzle which can readily and reliably be locked in any of a number of spray patterns.

SUMMARY OF THE INVENTION

Among the several objects of the present invention may be noted the provision of an improved spray nozzle for use on hoses such as watering hoses used to water lawns and gardens;

- the provision of such an improved spray nozzle to be readily attached to the end of a hose and operable to spray water when a manually controlled valve of the spray nozzle is opened;
- the provision of such an improved spray nozzle to be manually controlled to produce a wide range of spray patterns from a cone spray to a solid spray, to a flood spray pattern;
- the provision of such an improved spray nozzle having a manually operable clip for locking the position of a valve member in one position so a selected spray pattern can be maintained by the user without the user having to keep a constant grip pressure on the spray unit;
- the provision of such an improved spray nozzle in which the clip is readily movable from one position to another by a simple movement of the user, and to not stick or otherwise be difficult to manipulate;
- the provision of such an improved spray nozzle in which the clip remains in its position and does not slip out of position unless subsequently moved by the user from one position to another;
- the provision of such an improved spray nozzle to provide a quick release when spraying is complete, and to completely shut off spray of water, so there is no drippage from the nozzle even though the source of water has not been turned off;
- the provision of such an improved spray nozzle in which the clip is a low cost element readily installed in a spray nozzle assembly; and,

- the provision of such an improved spray nozzle to simplify a gardener's task in watering flowers, shrubs, and lawns, or for washing off driveways and sidewalks, or for cleaning the siding of houses, automobiles, etc.

In accordance with the invention, generally stated, a spray nozzle attaches to one end of a garden hose used to water lawns and gardens. A nozzle body has both a fluid inlet and a fluid outlet formed in it together with an interconnecting fluid passage. The inlet attaches to the end of the hose for water to flow through the nozzle body when the hose is turned on. The outlet forms an orifice through which the water discharges as a spray onto a lawn or garden. A valve mechanism includes a valve stem reciprocally movable through the nozzle body from a first position in which the stem blocks the orifice so water cannot be discharged, to a second position in which the stem is withdrawn from the orifice and water is discharged. A handle is grasped by a user of the hose and is attached to the stem to move the stem relative to the orifice. The extent of movement is a function of a desired water spray pattern of water. This pattern is maintained so long as a constant grip pressure is maintained on the handle by the user. A clip is movably mounted on the nozzle body and is movable by the user. The clip, when in place, engages a portion of the valve body and blocks movement of the handle. The clip holds the handle in a position in which the desired spray pattern is maintained even if the user releases their grip pressure. When watering is complete, the user can simply release the clip to shut off water discharge from the nozzle. Other objects and features will be in part apparent and in part pointed out hereinafter.

BRIEF DESCRIPTION OF THE DRAWINGS

In the drawings.

Corresponding reference characters indicate corresponding parts throughout the drawings.

DESCRIPTION OF A PREFERRED EMBODIMENT

Figures 1, 2, 3, 5:
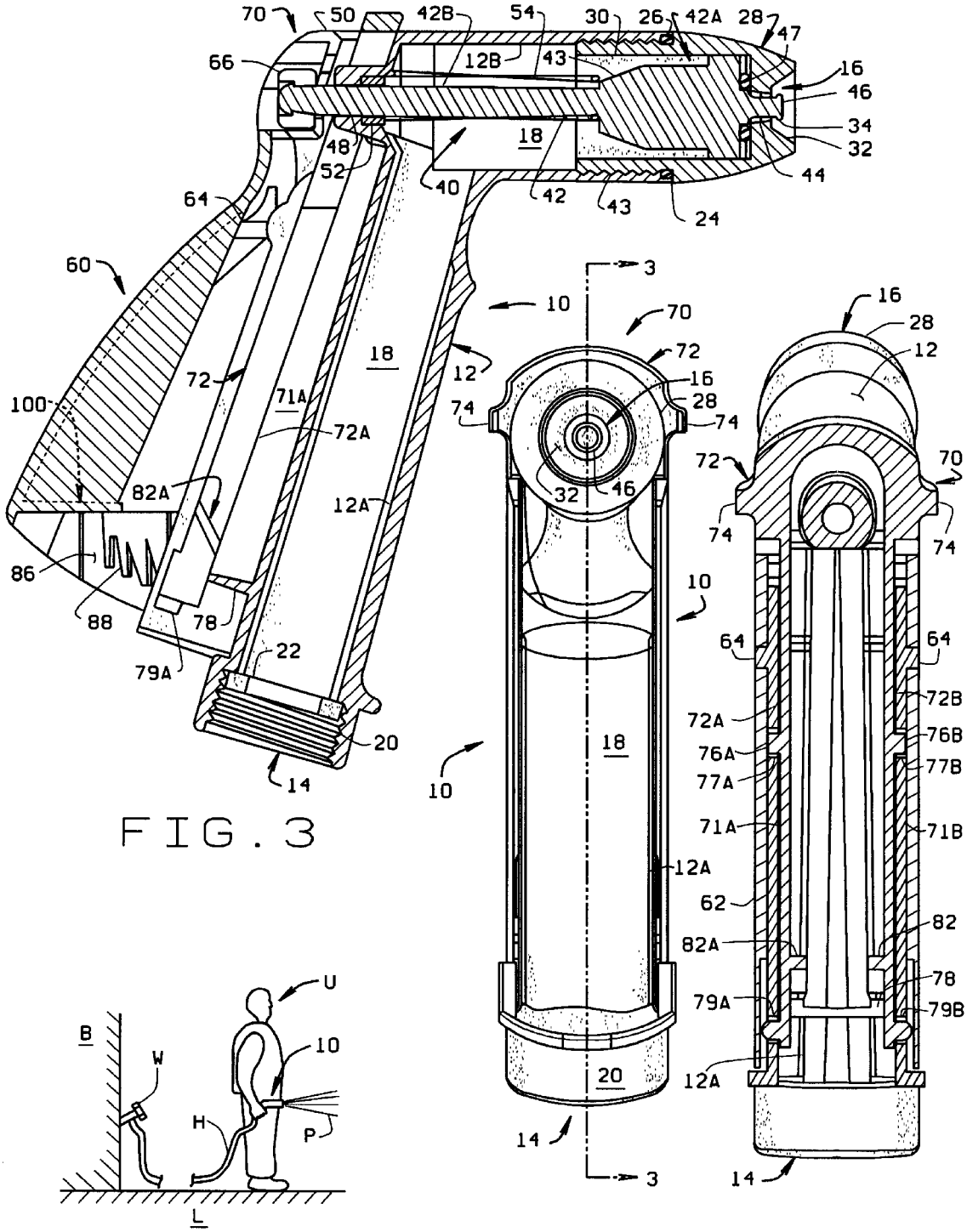
FIG. 1 illustrates a spray nozzle of the present invention attached to a hose for watering a lawn, for example.
FIG. 2 is a front elevational view, partially cutaway, of the nozzle.
FIG. 3 is a sectional view taken along line 3—3 in FIG. 2.
FIG. 5 is sectional view taken along line 5—5 in FIG. 4.

Referring to the drawings, a hose H such as a garden hose, has one end connected to a water spigot W, which is shown in FIG. 1 as being on the outside of a building B. A spray nozzle 10 of the present invention is attachable to the other end of the hose watering a lawns L, or a garden to encourage growth of grass or flowers, or to wash off drives and walkways, etc. In use, a user U grasps the spray nozzle and, as described hereinafter, manipulates it to achieve a desired spay pattern P of the water. Once the user has obtained a desired pattern, he or she can further manipulate the nozzle to maintain that pattern without having to keep a constant grip pressure on a handle portion of the spray nozzle. When a watering task is complete, the nozzle is readily operated to stop the spraying. Operation of the nozzle is simple, and maintenance of a desired spray pattern easily achieved.

Spray nozzle 10 first includes a body means 12 in which is formed a fluid inlet 14, a fluid outlet 16, and a fluid passage indicated generally 18 extending between the inlet and outlet. Body 12 is generally L-shaped having one leg 12A at the end of which is a threaded section 20 for connection of the spray nozzle to the appropriate end of the hose. A washer 22 is fitted in place between the threaded end of the body and the passage to form a seal preventing water leakage from the spray nozzle. The body has a second and shorter leg portion 12B which is internally threaded at its outer end. Further, a circumferential shoulder 24 is formed about the inner wall of the body at this end. An O-ring 26 fits in this shoulder for sealing purposes. An outlet body segment 28 has an end 30 matingly threaded so to attach to the threaded end of leg 12B. Body segment 28 is of a generally hollow, cylindrical shape with a closed endwall 32 in which is formed an orifice or opening 34. The sidewalls of the body segment flare outwardly from the opening to the outer end of the body segment, this flaring serving to form a resulting spray pattern when the nozzle is in use.

A valve means 40 includes a valve stem 42 reciprocally movable in leg 12B of the nozzle body. The valve stem includes a segment 42A having a plurality of ribs 43 annularly spaced about the stem. A reduced diameter section 44 of the stem is formed at the outer end of the stem. Section 44 is sized to fit in orifice 34 and, in turn, has an enlarged diameter tip end 46. An O-ring seal 47 fits between the reduced diameter section of the stem and the inner face of endwall 32 to seal outlet 16 when the spray is off. The length of stem section 44 is such that when the valve is closed, the tip end extends some distance from opening 34. However, when the stem is retracted away from the opening (i.e., from a first position in which the valve stem blocks the orifice and prevents water from being discharged from the nozzle) the enlarged tip end of the section is drawn toward orifice 34. The position of the tip end relative to the flared sidewall 34 of body segment 28 creates a spray pattern which is adjustable by the user. The stem further includes a uniform diameter section 42B which extends the length of the stem from the location of the ribs to the inner end of the stem. The inner end of the stem extends through an opening 48 in a rear wall 50 of body segment 12B. A seal 52 is seated against opening 48, to prevent water leakage through the opening, by one end of a coil spring 54. The other end of the spring bears against the ribs 43 to urge the valve stem into its position closing outlet 16.

Figure 4:
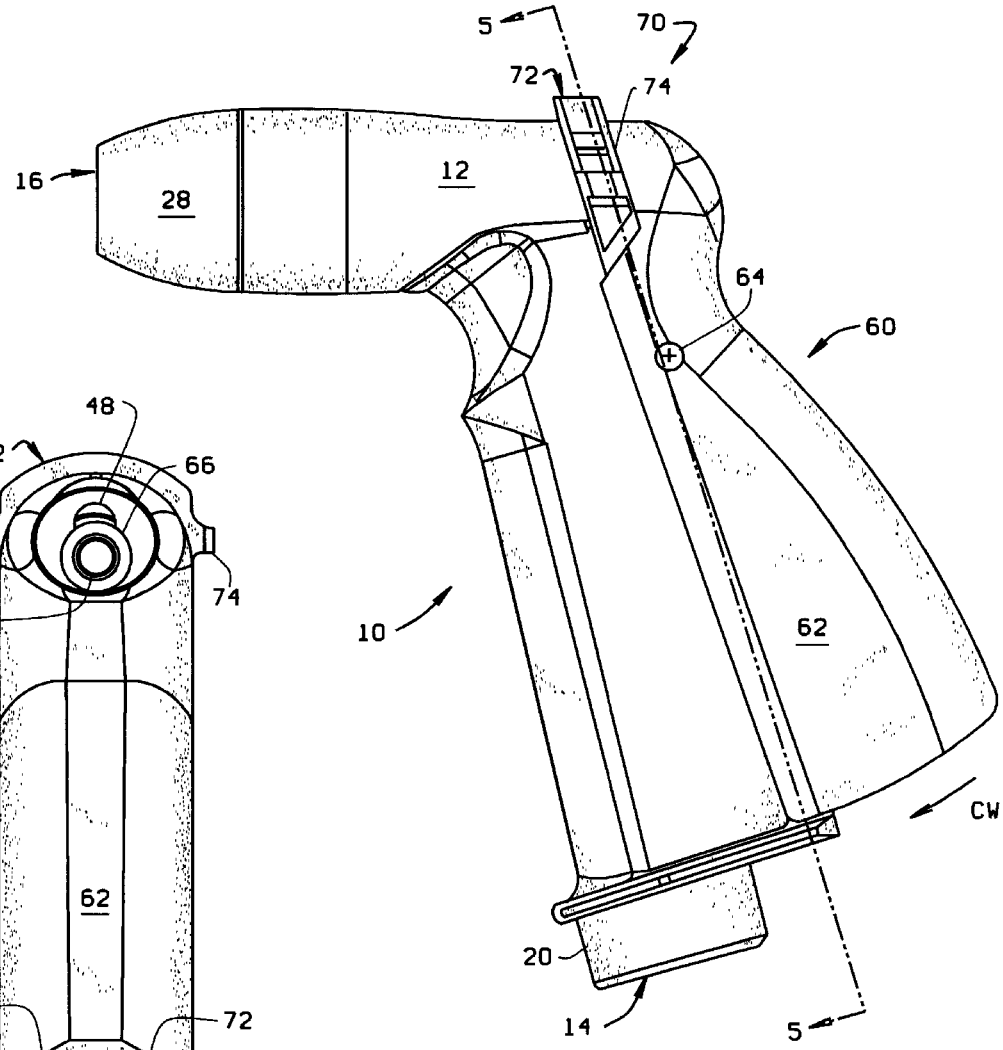
FIG. 4 is a side elevational view of the nozzle.
Figure 6:
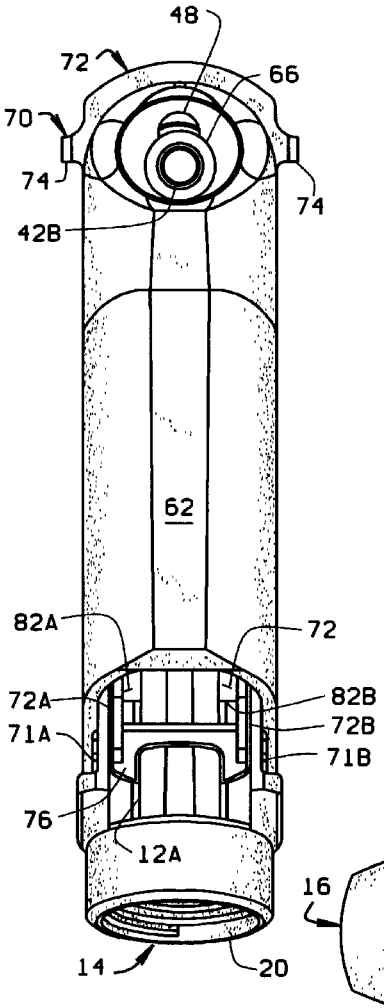
FIG. 6; is a rear elevational view of the nozzle.
Figure 7:
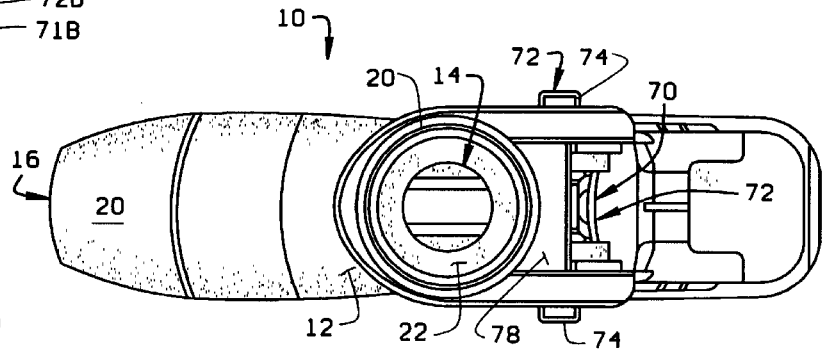
FIG. 7 is a bottom plan view of the nozzle.

Next, spray nozzle 10 includes a handle means 60 graspable by the user of the hose and movable thereby. The handle means includes a handle 62 which is pivotally attached to body 12 as indicated at 64 in FIGS. 4 and 5. Handle 62 is a pistol grip type handle by which a user can readily grasp the grip and move the valve stem by squeezing the grip. In FIG. 3, it will be seen that a substantial length of stem segment 42B protrudes through opening 48. A snap nut 66 captures the outer end of segment 42B, this being at a point above pivot 64. Thus, as the user more firmly squeezes the handle, the more stem 42 is withdrawn into the nozzle body. The extent of this movement is a function of a desired spray pattern from the nozzle. Typically, the more tightly the handle is gripped, the spray pattern produced goes from a cone spray to a solid spray, to a flood spray. Whatever the pattern, it is maintained so long as a constant grip pressure is maintained on the handle.

Next, spray nozzle 10 includes a clip means 70 comprising a manually operable clip 72. Clip 72 is a molded element having an elongate U-shape by which the clip is fitted between sidewalls 71A, 71B which are integrally formed with and extend rearwardly of nozzle body 12A. The clip has leg portions 72A, 72B which extend generally the length of body segment 12A along an inner surface of each of the sidewalls. As molded, the legs form spring members by which the legs are urged outwardly against the sidewalls 71A, 71B. The upper end of the clip is raised above the upper surface of body segment 12B of the nozzle and there are ears 74 formed on both sides of the clip, near the upper end of the clip as viewed in the drawings. When the nozzle is in use, and a desired spray pattern has been achieved, the user can move the clip, either by pressing down on the top of the clip, or on one of the ears 74, to hold handle 62 in a fixed position once the user releases their grip pressure.

Figure 8:
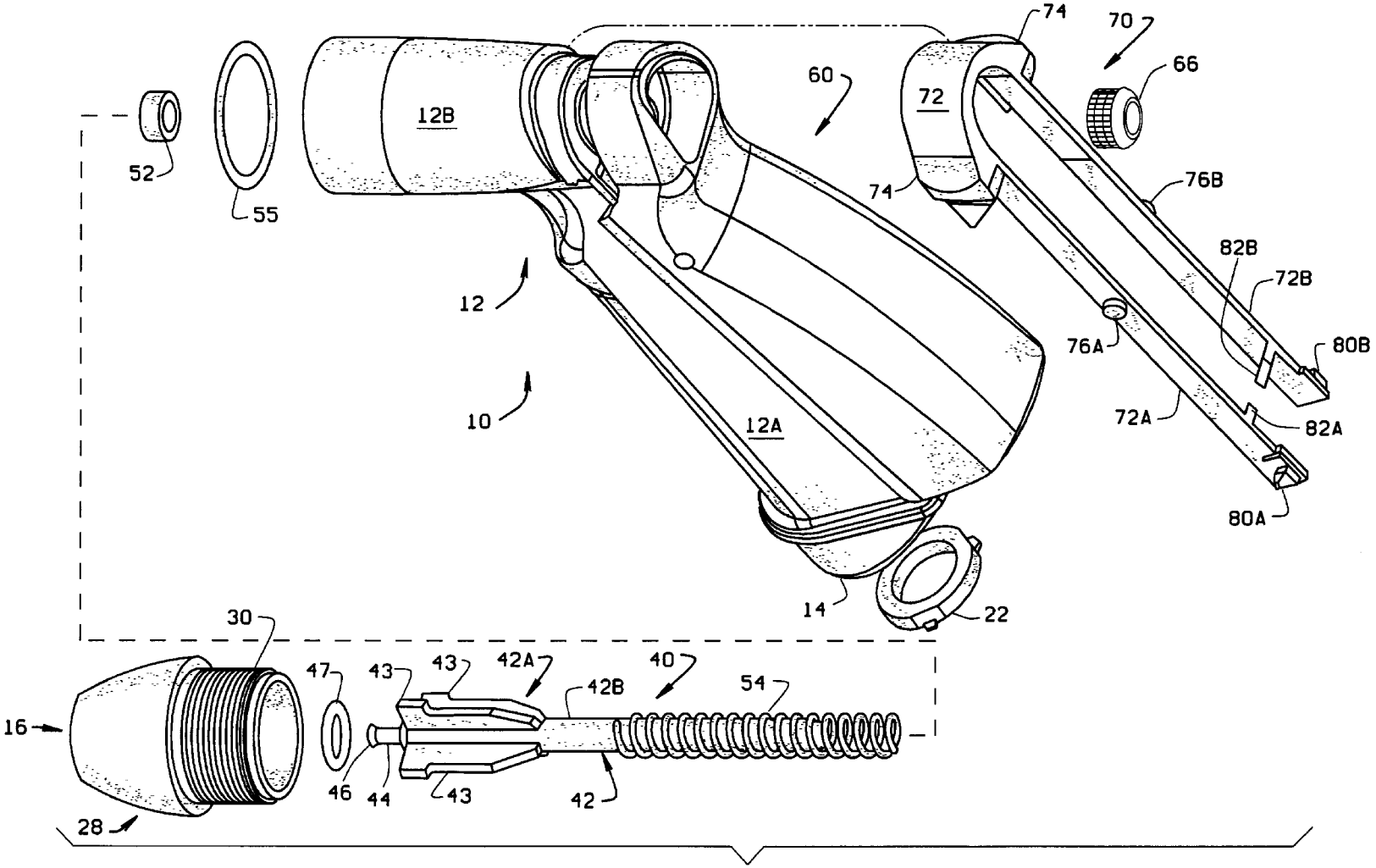
FIG. 8 is an exploded view of the spray nozzle.

As best shown in FIGS. 5 and 8, handle clip 72 includes a post 76A, 76B formed midway along the length of the respective legs 72A, 72B. These posts are received in respective slots 77A, 77B formed in sidewalls 71A, 71B. A rib 78 extends between sidewalls 71A, 71B, and the lower ends of the legs of clip 72 bear against this rib. At the lower end of each sidewall is a second slot 79A, 79B respectively. Each leg of the clip has a latch member, 80A, 80B respectively, which extends through this second slot when the clip is pushed downwardly by the user. As shown in FIGS. 5 and 8, respective tabs 82A, 82B extend inwardly from the respective legs 72A, 72B of the clip. These tabs interface with rib 100 on handle 60. When handle 60 is fully compressed, rib 100 pushes on tabs 82A and 82B and moves clip 72 vertically, retracting latch members 80A and 80B.

A ratchet 88 is formed on the inner wall 86 of handle 62, on both sides of the handle. When the handle is flexed inwardly by the grips, a different segment of the ratchet is moved adjacent slots 79A, 79B. When the user has moved the handle to the position for a desired spray, he pushes down on the top of the clip. Latch members 80A, 80B, now snap through the slots 79A, 79B to engage the ratchet. When this is done, and the user releases their hold on the grip, this engagement prevents the handle from being returned to initial relaxed position.

When the spray operation is complete, the user can regrip the handle, and using his or her finger lift the clip so that the latch members are retracted back inside the slots 79A, 79B. Now when the user the handle, the handle is returned to its normal relaxed position, this movement being assisted by the action of spring 54. Or, if the user pushes the handle all of the way forward, the ratchet 88 is moved such that fingers on the ratchet engage the respective latch members and push them back inside the slots 79A, 79B. This effectively unloads the clip, allowing the spring forces built into the clip to urge the clip upwardly, back to its position shown in FIG. 4. Again, when the user releases their grip on the handle, the handle is returned to its original, nozzle off, position. It will be appreciated that the use of the clip provides a convenient way to lock handle 62 in a wide range of positions by which a wide range of spray patterns can be obtained, and to provide a quick release mechanism when spraying is complete.

What has been described is an improved spray nozzle for attachment to a hoses used to water lawns and gardens. The nozzle is readily attached to the end of the hose and is operable to spray water when a manually controlled valve of the spray nozzle is opened. The nozzle is controllable to produce spray patterns ranging from a very concentrated pattern to a widely dispersed pattern. The nozzle has a manually operable clip which is manipulable to lock a valve member of the nozzle assembly in desired position so a selected spray pattern is maintained without the user having to keep a constant grip pressure on the nozzle. Movement of the clip is readily achieved by a simple movement of the user. And, the clip does not stick in one place and is not otherwise difficult to move. Further, the clip remains in place and will not slip out of position unless moved by the user from one position to another. The clip is a low cost element which is easily installed during assembly of the spray nozzle assembly.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A spray nozzle attachable to a garden hose or the like for watering lawns and gardens comprising:

a body in which is formed a fluid inlet, a fluid outlet, and a fluid passage extending between said inlet and said outlet, said inlet being formed for attachment to an end of said hose for fluid flow from the hose into said body when the hose is turned on, and said fluid outlet forming an orifice through which fluid discharges onto a lawn or garden;

a valve including a valve stem reciprocally movable through the body from a first position in which said valve stem blocks said orifice and prevents discharge of fluid from said body to a second position in which said valve stem is withdrawn from said orifice and fluid is discharged therethrough;

a handle graspable by a user of the hose and movable thereby, said handle being attached to said valve stem for moving said valve stem relative to said orifice with the extent of movement being a function of a desired nozzle spray pattern with the pattern being maintained so long as a constant grip pressure is maintained by the user on the handle, said handle including a ratchet movable with said handle when said handle is gripped by a user;

a clip movably mounted on said body and movable by the user, said clip, when in place, holding said handle in a position whereby the desired spray pattern is maintained even when the user releases their grip pressure, said clip being a manually operable clip whose position relative to said handle is adjustable by the user after the user has moved the handle to a position at which a desired spray pattern is attained;

a latch engaging said handle when said user manipulates the clip for a grip pressure exerted by a user to be effectively maintained by said clip to maintain a desired spray pattern even though said handle is released, the latch including a latch member engaging said ratchet when said clip is moved by the user thereby to prevent movement of the handle when grip pressure is released and thereby maintain a desired spray pattern.

2. The spray nozzle of claim 1 wherein said handle is pivotally attached to said body and said spray nozzle further includes an attachment attaching said valve stem to said handle, pivotal movement of said handle when grasped by a user causing movement of said valve stem away from said orifice.

3. The spray nozzle of claim 2 further including a spring biasing said valve stem toward said first position, said valve stem being moved away from said first position against the force of said spring when said handle is grasped by said user.

4. The spray nozzle of claim 3 wherein said body includes a body segment having sidewalls within which said clip is movable relative to the handle, each said sidewall having a slot therein through which said latch extends when the user pushes on the clip to lock said handle in a position for a desired spray pattern.

5. The spray nozzle of claim 4 wherein said clip is releasable by the user when spraying is completed, said ratchet having a finger engaging said latch member and returning it back through said slot to unload the blocking force on the handle exerted by said clip and allow said handle to return to an initial, relaxed position.

6. The spray nozzle of claim 5 wherein said clip is a U-shaped clip having spring-like legs mounted between said sidewalls, and said legs each having a post formed thereon and said sidewalls each having a second slot therein in which said posts are received for guiding movement of said clip.

7. The spray nozzle of claim 6 wherein said clip further includes a tab engaging said body segment to further guide movement of said clip.

8. A spray nozzle for use on a hose for producing and maintaining a desired pattern of water spray comprising:

a body in which is formed a fluid inlet, a fluid outlet, and a fluid passage extending between said inlet and said outlet, said body having a first body segment and a second body segment, said inlet being formed in said first body segment which is attached to one end of said hose, and said outlet being formed in said second body segment and forming an orifice through which fluid discharges;

a valve including a valve stem reciprocally movable through said second body segment from a position blocking said orifice to a position in which said valve stem is withdrawn from said orifice for water to discharge therethrough, one end of said valve stem having a reduced diameter section extending through said orifice, and said second body segment having an end wall in which said orifice is formed with an outer face of said end wall being contoured so that said contour and said reduced diameter section of said first valve stem segment together create a desired spray pattern;

a spring biasing said valve stem to the outlet closing position;

a handle pivotally connected to said first body segment and operable by a user of the hose and movable thereby, said handle being attached to said valve stem for moving said valve stem relative to said orifice, the extent of movement being a function of a desired nozzle spray pattern, said spray pattern being maintained so long as a constant grip pressure is maintained on the handle by the user;

a manually operable clip mounted adjacent said body and movable by the user when a desired nozzle spray pattern has been achieved, the position of the clip relative to said handle being adjustable by the user, and said clip being manually releasable by said user at the completion of spraying; and, said clip including a latch engaging said handle when said clip is moved into the aforesaid position by the user so to retain said handle in a desired position for a desired spray pattern when the user releases their grip.

9. The spray nozzle of claim 8 wherein said handle includes a ratchet movable with said handle when said handle is moved by a user, and the latch of said clip engages said ratchet to block a return movement of said handle when grip pressure is released thereby to hold the valve stem in a fixed position for a desired spray pattern.

10. The spray nozzle of claim 9 wherein said clip includes a tab frictionally engaging said first body segment to hold said clip in its plate blocking position.

11. In a spray nozzle for use on a hose spraying water in a desired pattern, the spray nozzle including a nozzle body in which is formed a fluid inlet, a fluid outlet, and a fluid passage extending between said inlet and said outlet, said body having respective first and second body segments, said inlet being formed in said first body segment which attaches to an end of said hose, and said outlet being formed in said second body segment and forming an orifice through which fluid discharges, the improvement comprising:

a valve including a valve stem reciprocally movable through said second body segment from a position blocking said orifice to a position in which said valve stem is withdrawn from said orifice for water to discharge therethrough;

a spring biasing said valve stem to its position blocking said orifice;

a manually operable handle pivotally attached to said first body segment and movable by a user of the hoses, said valve stem being connected to said handle for moving said valve stem relative to said orifice when said handle is moved, the extent of such movement being a function of a desired nozzle spray pattern, said spray pattern being maintained by the user maintaining a constant grip pressure on the handle; and, a manually operable clip mounted adjacent said body and said handle, said clip being movable by the user when a desired nozzle spray pattern has been achieved to frictionally engage said body and contact said handle to block movement of said handle when the user releases the grip pressure on the handle, blocking movement of said handle causing said valve stem to remain in the position to which it was moved by movement of said handle thereby maintaining the desired spray pattern, said clip being manually releasable by said user at the completion of spraying, said clip including a latch engaging said first body segment to hold said handle in place, and said handle including a ratchet movable with said handle when said handle is gripped by a user, said clip locking said handle in place until said clip is released by said user.

* * * * *